United States Patent [19]

Simich

[11] 4,092,912

[45] June 6, 1978

[54] PRESS PLATEN WEDGES

[75] Inventor: Emil Simich, Chicago, Ill.

[73] Assignee: A. J. Gerrard & Company, Des Plaines, Ill.

[21] Appl. No.: 695,065

[22] Filed: Jun. 11, 1976

[51] Int. Cl.[2] ..... B65B 13/02

[52] U.S. Cl. ..... 100/3; 100/25; 100/295

[58] Field of Search ..... 100/3, 295, 25, 26, 100/1

[56] References Cited

U.S. PATENT DOCUMENTS

| | | | |
|---|---|---|---|
| 261,984 | 8/1882 | Baxter | 100/1 |
| 1,469,511 | 10/1923 | Huebner | 100/295 |
| 2,674,535 | 4/1954 | Meisler | 100/295 |
| 3,195,445 | 7/1965 | Meisler | 100/295 |

FOREIGN PATENT DOCUMENTS

| | | | |
|---|---|---|---|
| 398,144 | 9/1933 | United Kingdom | 100/295 |

*Primary Examiner*—Billy J. Wilhite

*Attorney, Agent, or Firm*—Emrich, Root, O'Keeffe & Lee

[57] ABSTRACT

Apparatus for forming a bale of a material within a pair of press platens having a plurality of contoured platen wedges mounted to each of the press platens. The adjacently mounted platen wedges provide bale tie accommodating channels therebetween and permit the insertion of bale ties around the baled material. The platen wedges extend inwardly into the compression chamber engage the corners of the baled material to reduce the girth of the baled material and to provide a more dense bale.

4 Claims, 5 Drawing Figures

PRESS PLATEN WEDGES

BACKGROUND OF THE INVENTION

The present invention is directed to platen wedges for use in a press which is adapted to receive and compress a material or object under extreme pressures.

In the formation of a bale, the material to be baled is placed into the press and tightly compacted. While the material is held under pressure in the press, tie bands are secured about the bale through accommodating slots which are located within the surfaces of the upper and lower press platens. These tie bands are generally formed of cordage, wire or flat strips that are secured around the baled object. Because the accommodating slots are positioned within the pressed platens, when the pressure on the upper press platen is released, the compacted bale expands outwardly until the bale engages and is retained by bale ties. However, existing and prior art presses have not provided bales having a uniform density throughout and have not provided devices which yield an economy in the usage of the bale tie material. Additionally, in many instances, the bale ties are under considerably more stress in certain areas of the bale than in others.

SUMMARY OF THE INVENTION

It is one object of the present invention to provide a compacted bale having a reduced girth due to shaping the bale during compaction.

It is a further object of the present invention to provide a bale of a material having an increased uniform density throughout.

In accordance with the present invention, an open-sided bale press for forming compressed bales of material includes upper and lower press platens, which define a compression chamber therebetween. The upper press platen is movable up and down to form and to release the baled material. A plurality of contoured platen wedges are mounted to each of the press platens and extend into the compression chamber. The adjacently mounted wedges are positioned and spaced apart to provide recessed bale tie accommodating channels in each of the upper and lower press platens.

Accordingly, when the material to be baled is positioned within the compression chamber, and the upper press platen is moved downwardly, the platen wedges on the press platens engage the corners of the compressed bale to thereby shape the baled material in the press to a geometric shape similar to that of a tied bale out of the press. When the press platens have shaped the bale to the desired density and the platen wedges have reduced the girth of the bale, bale ties are inserted into the desired bale tie accommodating channels and tied around the bale. After the upper press platen is released, the bale having a greater density is removed from the press.

DETAILED DESCRIPTION

Figure 1:
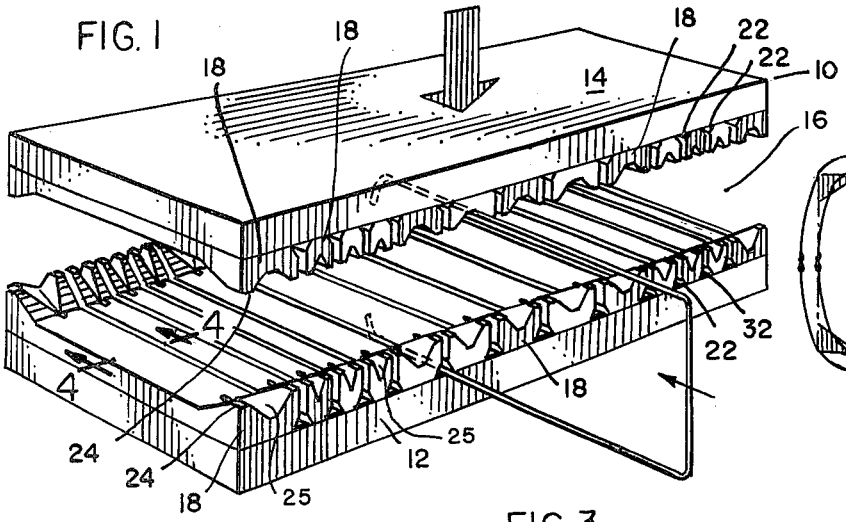
FIG. 1 is a perspective view of a baling press incorporating apparatus in accordance with the present invention.

Referring now to the drawings, wherein like reference numerals are used throughout the several views to identify the same parts, in FIG. 1 there is shown a baling press 10 comprising a stationary lower base platen 12 and an upper movable platen 14 which is actuated by a ram or other means (not shown) and movable up and down to compresss and release the bale. The lower and upper platens 12 and 14 define a compression chamber 16 therebetween. The baling press 10 is useful in baling materials, such as cotton, stable fibers, paper and the like.

Figure 4:
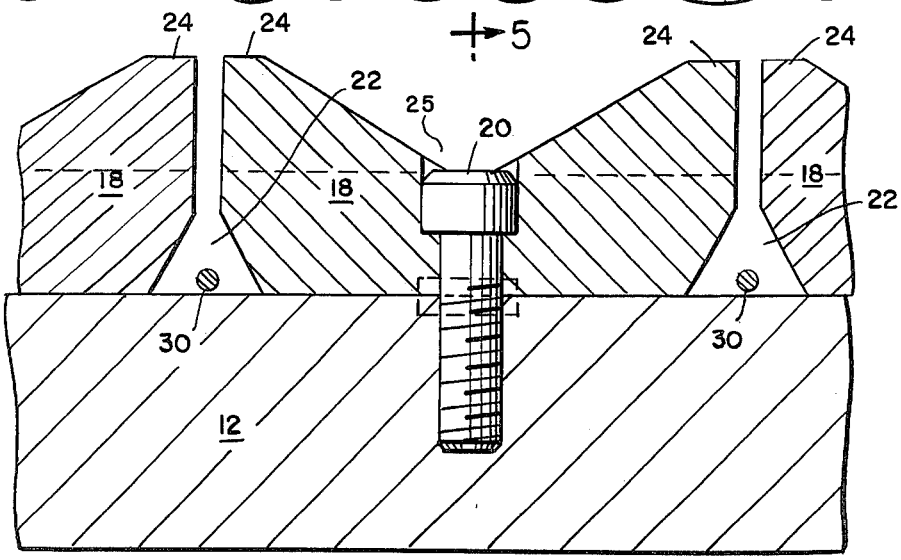
FIG. 4 is a partial cross-sectional view taken along line 4—4 in FIG. 1 looking in the direction indicated by the arrows.
Figure 5:
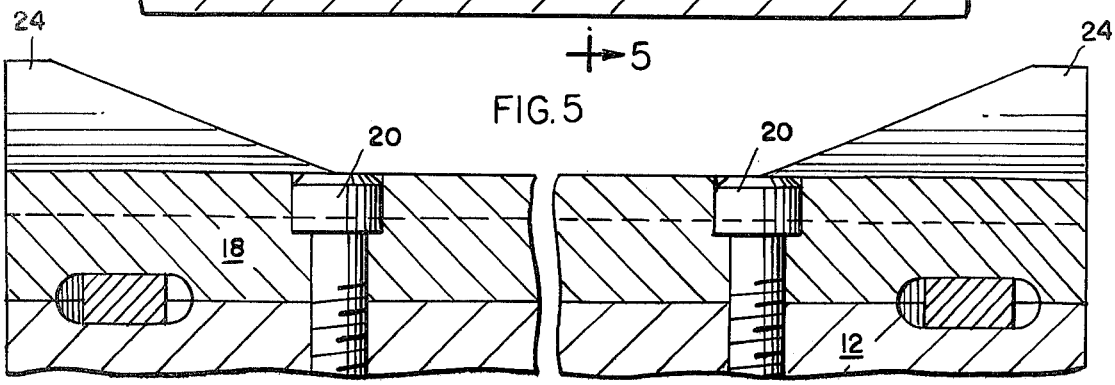
FIG. 5 is a partial cross-sectional view taken along line 5—5 in FIG. 4 looking in the direction indicated by the arrows.

Mounted to each of the lower and upper platens 12 and 14 are a plurality of contoured platen wedges 18. The contoured platen wedges 18 are preferably attached by bolts or fastening means 20 (FIGS. 4 and 5) to the platens 12 and 14, however, it is within the scope of the present invention to either integrally attach the contoured wedges 18 to the platens 12 and 14 by welding the wedges to the platens or manufacture the contoured wedges integral to the lower or upper platens.

Each of the contoured wedges 18, mounted to the lower and upper platens 12 and 14, are spaced apart with respect to one another to provide a space or bale tie accommodating channel 22 (FIG. 4) therebetween. The wedges 18 are mounted to the platens 12 and 14 such that the bale tie accommodating channels 22 in the upper platens 14 are in aligned relationship with respect to the accommodating channels 22 in the lower platen 12. The aligned relationship of the accommodating channels 22 permit the insertion of a bale tie 30 (FIGS. 1 and 4) through the channels to surround the baled material in the press, as is known in the art.

The contour platen wedges 18 include end projection portions 24 which extend into the compression chamber 16 to engage the corner of the baled material (not shown in FIG. 1) and exert a greater force upon the baled material at the corners thereof. Thus, when the baled material is under compression, bale ties 30 are inserted into the bale tie accommodating channels 22, as shown in FIG. 1, to firmly tie the bale. The bale ties 30 may either be composed of flat steel, round wire or plastic.

The platen wedges 18 of the present invention, preferably extend across the width of the platens 12 and 14, as shown in FIG. 1. The contoured end portions 24 are described and intended to function as a contoured or concave surface with respect to the compression chamber 16. Although the wedges 18 are shown as presenting a pair of contoured end portions 24 separated by a groove 25, it is within the scope of the present invention to include individual contoured wedges mounted to the lower and upper press platens 12 and 14.

Figure 2:
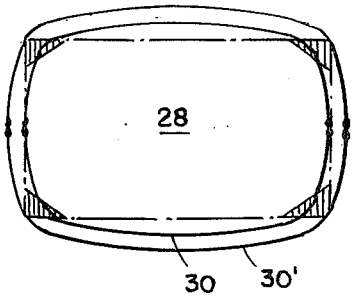
FIG. 2 is cross-sectional view of a bale of material being compressed by the apparatus of the present invention.

Because the end projection portions 24 of the wedges 18 are contoured to present a somewhat concave surface to the baled material, they exert a greater force on the baled material at the tuck point or corner of the bale 28 (FIG. 2) where the bale tie 30 encircles the bale. This greater force at the corners of the bale 28 (FIG. 2), permits the use of a smaller length of bale tie 30 (FIG. 2) to encircle the bale and results in a greater bale density to be maintained on the bale when the compression on upper platen 14 is released. As shown in FIG. 2, bale tie 30' is of necessity of greater length, when conventional press platens are utilized, to encircle a bale than when a shorter length bale tie 30 is utilized to encircle a bale compressed in accordance with the present invention.

A further advantage of the present invention is that the use of the contoured platen wedges actually bevel the corners of the bale to reduce the circumference around the bale. This permits the utilization of a reduced length of tie band for tying the bale and permits the accommodation of oversize bales with the same size band ties to maintain equal size or volume of both light and heavy bales of uniform size.

Figure 3:
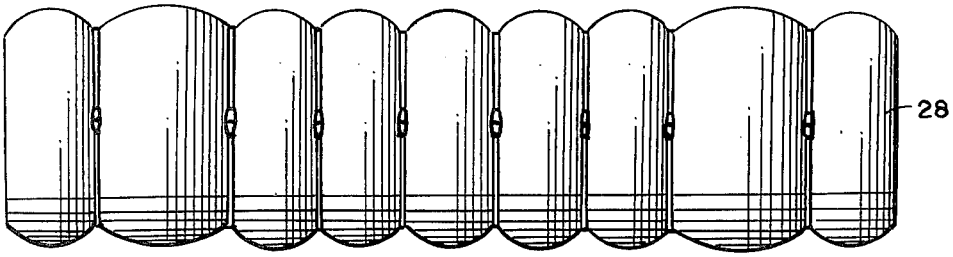
FIG. 3 is a perspective view of a bale of material which has been compressed by the apparatus of the present invention.

FIG. 3 shows a bale of material which has been compressed by the apparatus in accordance with the present invention. Although FIG. 3 indicates that every bale accommodating slot has received a tie band to encircle the bale, in many applications it is possible to eliminate one or more of the tie bands necessary to tie a bale.

It is apparent from the foregoing disclosure that the contoured platen wedges mounted to the press platen results in a press apparatus which applies a greater force at the corners of a bale so that a smaller length of tie band may be used to encircle the bale. Such an apparatus and method provide a bale having a greater density to be maintained on the bale when the upper platen is released.

I claim:

1. In a bale press for forming a bale of material between a pair of press platens in a compression chamber and wherein bale ties are secured about the bale, including in combination, a plurality of wedge means on each of the press platens each of said wedge means including two spaced corner end projection portions at each end thereof integral thereto and extending into the compression chamber, each of said wedge means and said corner end projection portions thereon are positioned on each of the press platens such that adjacent wedge means and said corner end projection portions thereon provide bale tie accommodating channels therebetween and about the compression chamber with said accommodating channels on one of said press platens being in aligned relationship with said accommodating channels on the other of said press platen, such that when one of the press platens is moved towards the other press platen, said corner end projection portions on each of said wedge means engage the corners of the baled material to thereby selectively reduce the girth of the bale where said corner end projection portions engage the corners of the bale.

2. The bale press according to claim 1 wherein said wedge means is a plurality of contoured platen wedges each have corner end projections and providing bale tie accommodating channels therebetween and with each corner end projection which extend into the compression chamber to engage the corners of the baled material to thereby reduce the girth of the bale.

3. The bale press according to claim 1 further including fastening means for mounting said wedge means to each of the press platens.

4. A method of producing high density bales of a material comprising:

compressing the material to be baled between a pair of press platens defining a compression chamber therebetween, each of said platens having a plurality of contoured platen wedges mounted thereon in aligned relationship, with each of said contoured platen wedges further having two spaced corner end means at each end thereof extending into the compression chamber which provide bale tie accommodating channels between adjacently mounted platen wedges to thereby provide a reduced girth on the bale where said corner end means on said wedges engage the corners of the bale, inserting tie means into the bale tie accommodating channels to encircle the compressed bale of material having a reduced girth where said corner end means on said wedges engage the corners of the bale, securing said tie means to said compressed bale of material, and releasing the press platens to provide a high density bale of material.

* * * * *